US012687074B2

(12) United States Patent
Subbiah et al.

(10) Patent No.: US 12,687,074 B2
(45) Date of Patent: Jul. 21, 2026

(54) SYSTEM FOR MOVING MAST OF DRILLING MACHINE

(71) Applicant: Caterpillar Inc., Peoria, IL (US)

(72) Inventors: Anand Subbiah, Chennai (IN); R Prasana, Chennai (IN); Jegatheesh Chidambaram, Nagercoil (IN); Partiban Chengalvarayan, Chennai (IN)

(73) Assignee: Caterpillar Inc., Peoria, IL (US)

( * ) Notice: Subject to any disclaimer, the term of this patent is extended or adjusted under 35 U.S.C. 154(b) by 239 days.

(21) Appl. No.: 18/661,766

(22) Filed: May 13, 2024

(65) Prior Publication Data

US 2025/0347174 A1 Nov. 13, 2025

(51) Int. Cl.
*E21B 7/02* (2006.01)

(52) U.S. Cl.
CPC ..... *E21B 7/023* (2013.01)

(58) Field of Classification Search
CPC ..... E21B 7/023; F15B 13/0433
See application file for complete search history.

(56) References Cited

U.S. PATENT DOCUMENTS

| | | | | |
|---|---|---|---|---|
| 3,902,561 | A | 9/1975 | Friberg et al. | |
| 4,834,135 | A * | 5/1989 | DiBartolo | F16K 15/182 251/282 |
| 9,850,919 | B2 | 12/2017 | Zaehe | |
| 10,428,845 | B1 * | 10/2019 | Bianchi | F15B 11/0445 |
| 10,590,962 | B2 | 3/2020 | Coolidge et al. | |
| 10,683,879 | B1 | 6/2020 | Zähe | |
| 11,353,127 | B2 * | 6/2022 | Zähe | F16K 17/048 |
| 2020/0011353 | A1 * | 1/2020 | Diecke | E04H 12/345 |

FOREIGN PATENT DOCUMENTS

| | | |
|---|---|---|
| CN | 206054415 | 3/2017 |
| GB | 815990 | 7/1959 |
| JP | 2013002453 | 1/2013 |

* cited by examiner

*Primary Examiner* — Nathaniel C Chukwurah

(57) ABSTRACT

A system for moving a mast of a drilling machine includes a hydraulic actuator defining a rod end and a head end. The rod end of the hydraulic actuator is coupled to the mast to move the mast about a pivot axis. The system also includes a fluid line in fluid communication with the head end of the hydraulic actuator. The system further includes a counterbalance valve disposed in the fluid line. The counterbalance valve is disposed in fluid communication with the head end of the hydraulic actuator. The counterbalance valve includes an atmospheric vent passage. During a lowering operation of the mast, a back pressure in the hydraulic actuator is alleviated, via the atmospheric vent passage.

20 Claims, 5 Drawing Sheets

SYSTEM FOR MOVING MAST OF DRILLING MACHINE

TECHNICAL FIELD

The present disclosure relates to a drilling machine, a mast assembly for the drilling machine, a system for moving a mast of the drilling machine.

BACKGROUND

Drilling machines include a mast that is movably coupled to a frame of the drilling machine. The mast may support a component, for example, a hammer, a drill pipe, and the like to perform one or more drilling operations. The drilling machine includes one or more hydraulic actuators to rotate the mast about a pivot axis. The mast moves between a transport position and a drilling position based on extension and retraction of the hydraulic actuators. For example, the mast is raised to the drilling position when the hydraulic actuators are extended, and the mast is lowered to the transport position when the hydraulic actuators are retracted. The hydraulic actuators are telescopic, and long stroke cylinders that cause movement of the mast.

The drilling machine includes one or more counterbalance valves disposed in a return line of the hydraulic actuators. The return line is in fluid communication with a head end of the hydraulic actuator. During the lowering of the mast, a back pressure is generated in the hydraulic actuator and the return line. If the back pressure generated is not alleviated and exceeds a predefined amount, the back pressure may cause failure of a sealing element of the corresponding hydraulic actuator. The failure of the sealing element may cause undesirable leakage in the hydraulic actuators, which may impact a performance of the drilling machine.

Generally, the counterbalance valve is internally vented via a drain hose to reduce the back pressure in the hydraulic actuator and the return line. The drain hoses are typically long in length as they connect the counterbalance valve with a tank to direct fluid for example, oil, from the counterbalance valve to the tank. However, such long drain hoses may be challenging to incorporate, and may increase a complexity and a number of parts associated with the drilling machine.

U.S. Patent Publication Number 10,590,962 describes an exemplary valve section that includes a valve body configured to be fluidly coupled to the source and the actuator; a spool movable in the valve body intermediate the source and the actuator; a pressure compensator valve disposed upstream from the spool and configured to regulate flow received from the source, where the valve body defines (i) a first passage disposed upstream from the spool and configured to fluidly couple the pressure compensator valve to the spool, and (ii) a second passage disposed downstream from the spool and configured to fluidly couple the spool to the actuator; and a counterbalance valve disposed in the second passage downstream from the spool, where the counterbalance valve is opened to permit flow therethrough from the actuator to the spool in response to a pilot pressure derived from the first passage when the spool is shifted from a neutral position.

SUMMARY OF THE DISCLOSURE

In an aspect of the present disclosure, a system for moving a mast of a drilling machine is provided. The system includes a hydraulic actuator defining a rod end and a head end. The rod end of the hydraulic actuator is coupled to the mast to move the mast about a pivot axis. The system also includes a fluid line in fluid communication with the head end of the hydraulic actuator. The system further includes a counterbalance valve disposed in the fluid line. The counterbalance valve is disposed in fluid communication with the head end of the hydraulic actuator. The counterbalance valve includes an atmospheric vent passage. During a lowering operation of the mast, a back pressure in the hydraulic actuator is alleviated, via the atmospheric vent passage.

In another aspect of the present disclosure, a mast assembly for a drilling machine is provided. The mast assembly includes a mast. The mast assembly also includes a system for moving the mast. The system includes a hydraulic actuator defining a rod end and a head end. The rod end of the hydraulic actuator is coupled to the mast to move the mast about a pivot axis. The system also includes a fluid line in fluid communication with the head end of the hydraulic actuator. The system further includes a counterbalance valve disposed in the fluid line. The counterbalance valve is disposed in fluid communication with the head end of the hydraulic actuator. The counterbalance valve includes an atmospheric vent passage. During a lowering operation of the mast, a back pressure in the hydraulic actuator is alleviated, via the atmospheric vent passage.

In yet another aspect of the present disclosure, a drilling machine is provided. The drilling machine includes a frame. The drilling machine also includes a mast coupled to the frame that is movable relative to the frame. The drilling machine further includes a system for moving the mast relative to the frame. The system includes a hydraulic actuator defining a rod end and a head end. The rod end of the hydraulic actuator is coupled to the mast to move the mast about a pivot axis. The system also includes a fluid line in fluid communication with the head end of the hydraulic actuator. The system further includes a counterbalance valve disposed in the fluid line. The counterbalance valve is disposed in fluid communication with the head end of the hydraulic actuator. The counterbalance valve includes an atmospheric vent passage. During a lowering operation of the mast, a back pressure in the hydraulic actuator is alleviated, via the atmospheric vent passage.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
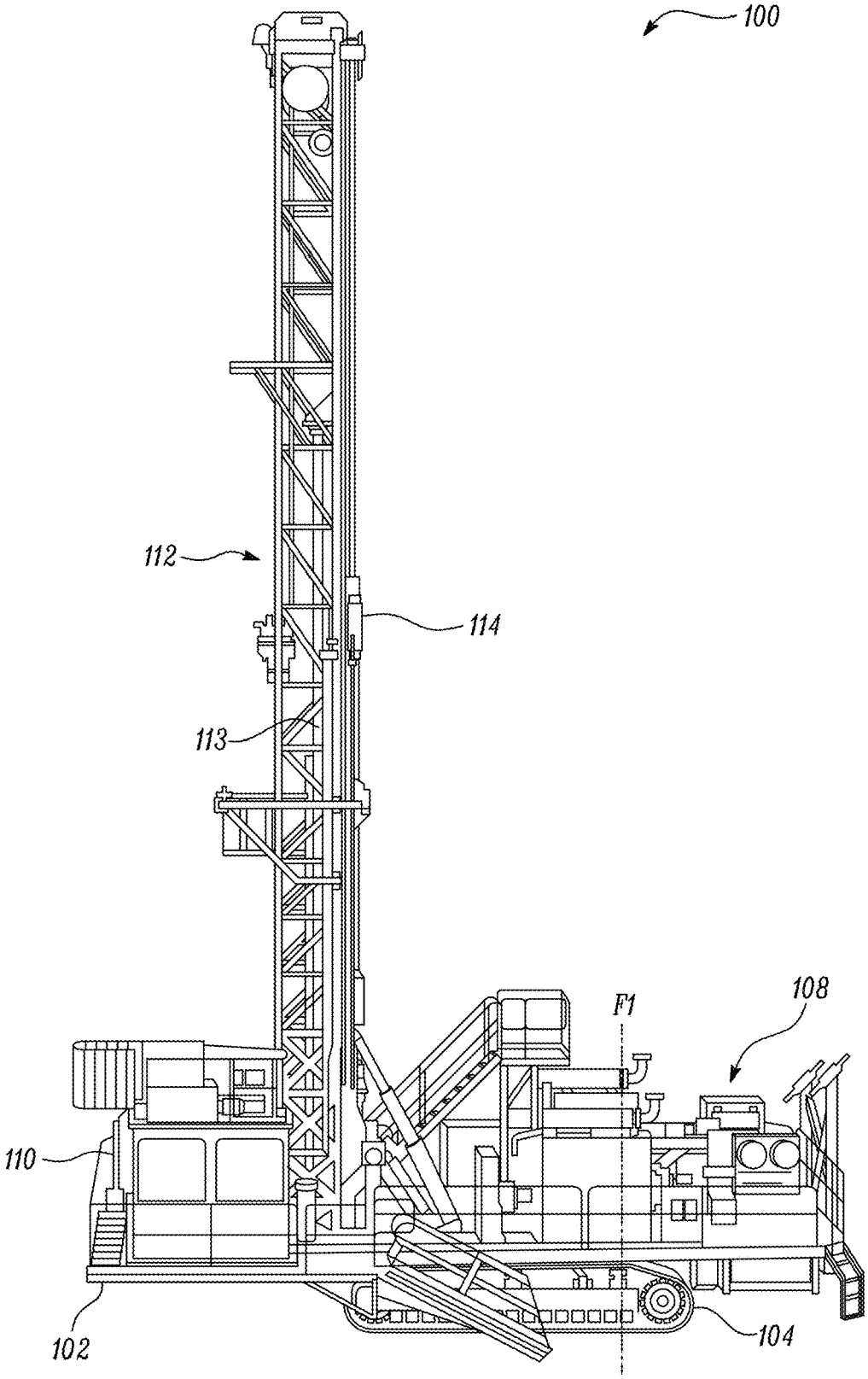
FIG. 1 is a schematic side view of an exemplary drilling machine.

Referring to FIG. 1, a schematic side view of an exemplary drilling machine 100 is illustrated. The drilling machine 100 may be used to perform one or more drilling operations, such as, drilling holes, mining blast holes or geothermal wells, and the like. The drilling machine 100 may include a rotary drilling machine or a down-the-hole drilling machine. In the illustrated example of FIG. 1, the drilling machine 100 is embodied as the rotary drilling machine. The drilling machine 100 defines a first axis "F1". The first axis "F1" extends generally in a vertical direction.

As shown in FIG. 1, the drilling machine 100 includes a frame 102. The frame 102 may be supported on a ground surface by a transport mechanism, such as, crawler tracks 104. The crawler tracks 104 may allow the drilling machine 100 to maneuver on ground surfaces to a desired location for performing drilling operations. Alternatively, the drilling machine 100 may include wheels instead of the crawler tracks 104. The frame 102 includes one or more jacks (not shown herein) for supporting and leveling the drilling machine 100 on the ground surface during drilling operations. In an example, the one or more jacks may lift the drilling machine 100 above the ground surface along the first axis "F1" during drilling operations. The drilling machine 100 also includes a machinery 108. The frame 102 may support the machinery 108, which may include various components (not shown), such as, a power source (for example, an engine, a battery system, and/or a fuel system), motors, batteries, pumps, air compressors, and/or any other equipment necessary to supply power to operate the drilling machine 100. The frame 102 further supports an operator cabin 110, from which an operator may maneuver and control the drilling machine 100.

The drilling machine 100 includes a mast assembly 112. The mast assembly 112 may be supported by the frame 102 of the drilling machine 100. The mast assembly 112 extends along the first axis "F1". The drilling machine 100 also includes a mast 113 coupled to the frame 102 that is movable relative to the frame 102. Specifically, the mast assembly 112 includes the mast 113.

The drilling machine 100 further includes a drill head 114 movable relative to the mast assembly 112. The drill head 114 is movable along the first axis "F1" and supported on the mast 113. The machinery 108 may provide power to operate the drill head 114 relative to the mast assembly 112. In some examples, the drilling machine 100 may include one or more motors (not shown) associated with the drill head 114. The drilling machine 100 also includes a drill pipe (not shown) or a hammer (not shown) coupled to the drill head 114 to perform drilling operations.

Figure 2:
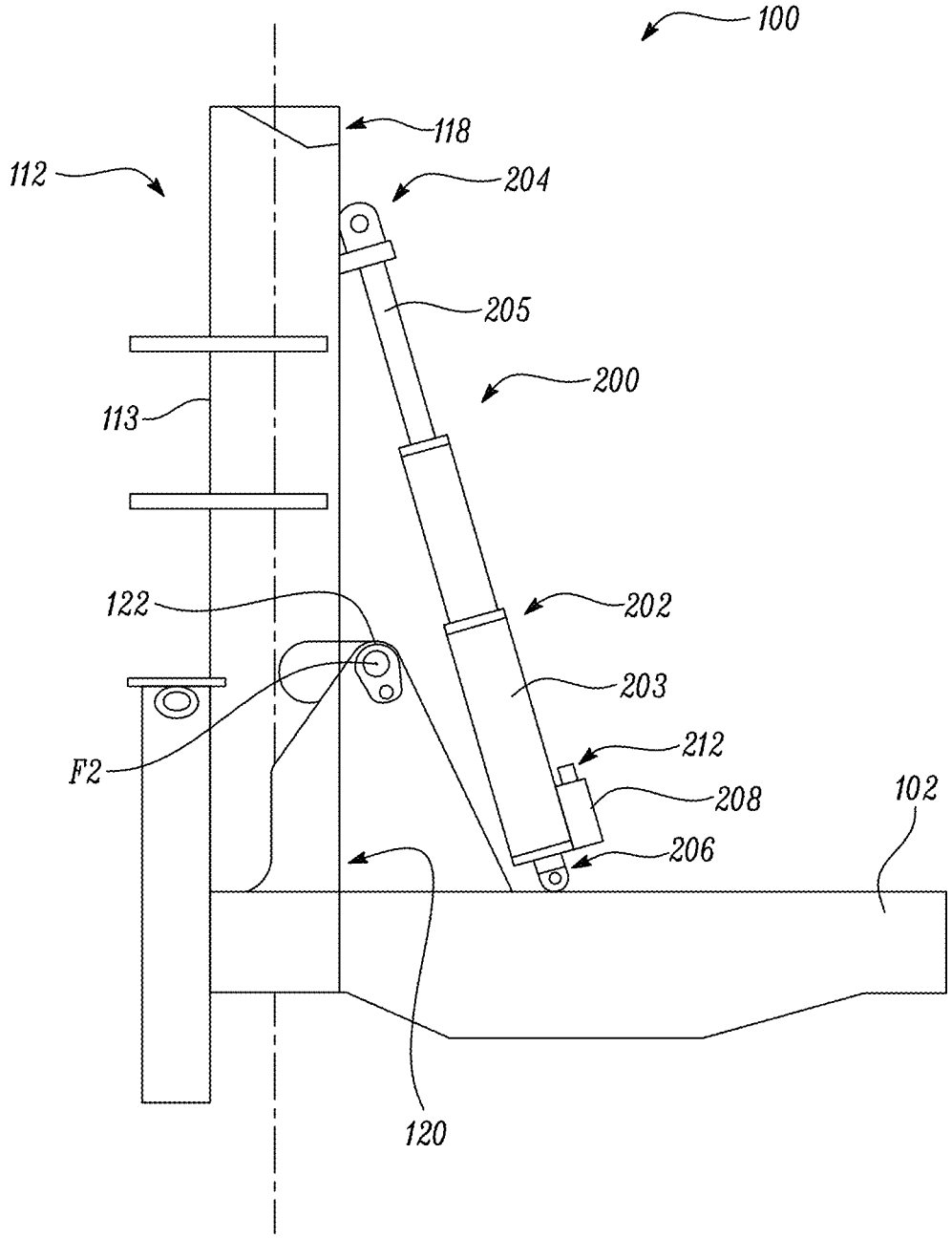
FIG. 2 is a schematic view of a portion of a mast assembly associated with the drilling machine of FIG. 1.

Referring to FIG. 2, a schematic view of a portion of the mast assembly 112 of FIG. 1 is illustrated. The mast assembly 112 also includes a linkage 122 that allow the mast 113 to rotate about a pivot axis F2. The mast 113 has a first end 118 and a second end 120. The second end 120 is opposite to the first end 118. The first end 118 is away from the frame 102, whereas the second end 120 is proximal to the frame 102.

The mast assembly 112 further includes a system 200 for moving the mast 113. The system 200 includes a hydraulic actuator 202 defining a rod end 204 and a head end 206. The hydraulic actuator 202 includes a cylinder 203 and a rod member 205 that moves relative to the cylinder 203. The rod end 204 of the hydraulic actuator 202 is coupled to the mast 113 to move the mast 113 about the pivot axis F2. Specifically, the rod end 204 is coupled to the first end 118 of the mast 113. Further, the head end 206 of the mast 113 is coupled to the frame 102. The system 200 includes a pair of hydraulic actuators 202. It should be noted that only one hydraulic actuator 202 is illustrated in the view shown in FIG. 2. Alternatively, the system 200 may include only one hydraulic actuator 202 or more than two hydraulic actuators 202, based on application attributes.

The hydraulic actuator 202 is movable between a retracted position and an extended position based on supply of a fluid. In some examples, the fluid may be oil or any other type of hydraulic fluid. A movement of the hydraulic actuator 202 from the retracted position to the extended position causes the mast 113 to raise for example, from a transport position to a drilling position. A movement of the hydraulic actuator 202 from the extended position to the retracted position causes the mast 113 to lower for example, from the drilling position to the transport position. The term "transport position" as used herein corresponds to a position of the mast 113 at which the mast 113 extends parallel to the frame 102 thereby forming a zero-degree angle relative to the frame 102. The term "drilling position" as used herein corresponds to a position of the mast 113 at which the mast 113 extends vertically with respect to the frame 102 thereby forming a 90 degrees angle relative to the frame 102. The hydraulic actuator 202 is illustrated in the extended position in FIG. 2.

The system 200 further includes a manifold 208 coupled to the hydraulic actuator 202 proximal to the head end 206 of the hydraulic actuator 202. Specifically, the manifold 208 is coupled to the cylinder 203. The manifold 208 may be a hollow structure. The manifold 208 is coupled to the hydraulic actuator 202 by one or more fastening means, a welding process, or a forging process. The fastening means may include bolts. Accordingly, the manifold 208 may be coupled to the cylinder 203 using a bolt-on process.

Figure 3:
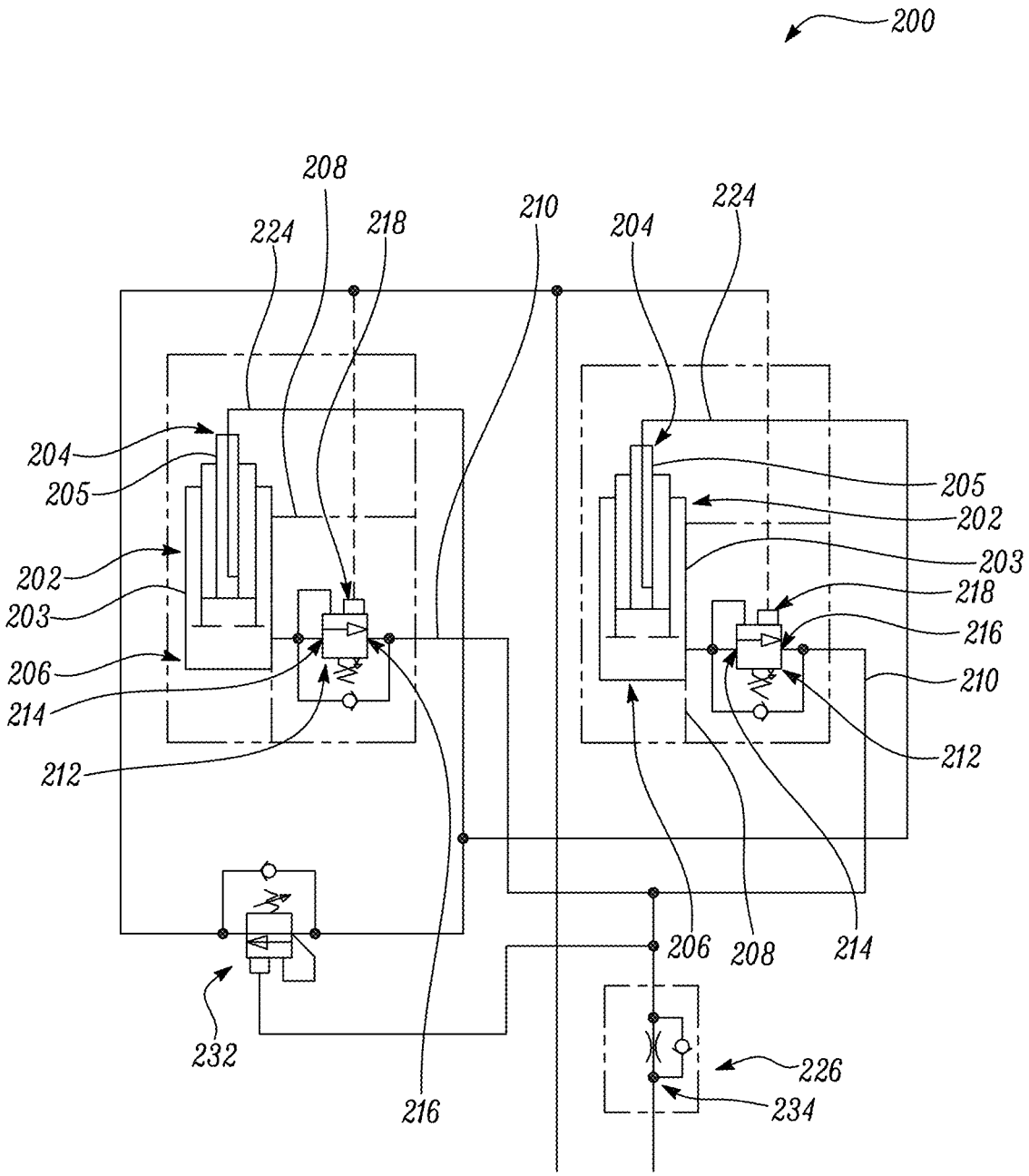
FIG. 3 is a schematic view of a system for moving a mast of the mast assembly of FIG. 2.

Referring to FIG. 3, a schematic view of the system 200 of FIG. 2 is illustrated. The system 200 includes a fluid line 210 in fluid communication with the head end 206 of the hydraulic actuator 202. The system 200 also includes a fluid supply line 224 in fluid communication with the rod end 204 of the hydraulic actuator 202. Each of the fluid line 210 and the fluid supply line 224 are connected to a fluid tank (not shown) alternatively as per a valve position. The system 200 further includes a reverse free flow check valve 226 disposed in the fluid line 210. The reverse free flow check valve 226 includes an orifice 234.

The system 200 includes a counterbalance valve 212 disposed in the fluid line 210. The counterbalance valve 212 is disposed in fluid communication with the head end 206 of the hydraulic actuator 202. It should be noted that the system 200 includes two counterbalance valves 212 disposed in a corresponding fluid line 210 of a corresponding hydraulic actuator 202. Further, the counterbalance valve 212 is disposed between the orifice 234 and the head end 206 of the hydraulic actuator 202. The orifice 234 is in fluid communication with the head end 206 of the hydraulic actuator 202 via the counterbalance valve 212. Further, the counterbalance valve 212 is coupled to the manifold 208. In some examples, the counterbalance valve 212 may be at least partially disposed within the manifold 208. In some examples, the counterbalance valve 212 may be coupled to the manifold 208 via threading or bolting using slip on cartridges.

Figure 4:
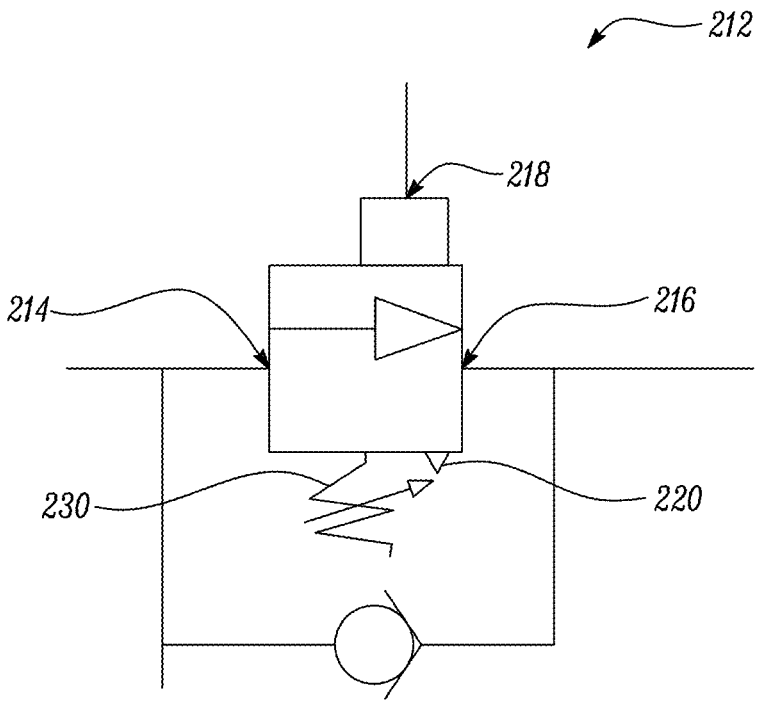
FIG. 4 is a schematic diagram of a counterbalance valve associated with the system of FIG. 3.
Figure 5:
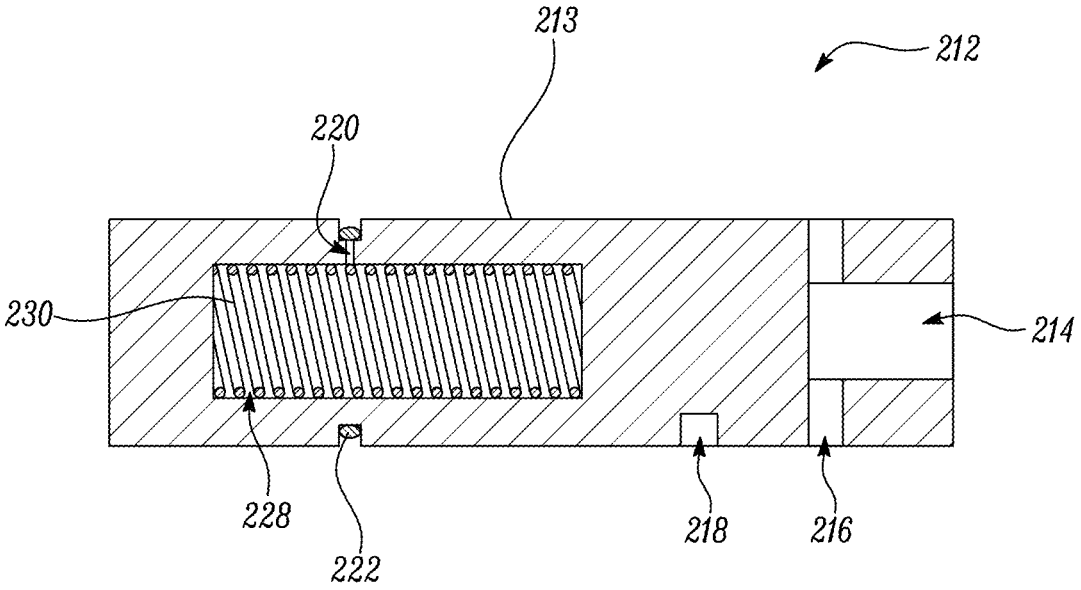
FIG. 5 is a schematic cross-sectional view of the counterbalance valve associated with the system of FIG. 3.

Referring to FIG. 4, a schematic diagram of the counterbalance valve 212 is illustrated. Referring to FIG. 5, a schematic cross-sectional view of the counterbalance valve 212 is illustrated. It should be noted that only components relevant to the present disclosure are illustrated in FIG. 5. Other components of the counterbalance valve 212 are omitted from FIG. 5. Referring to FIGS. 4 and 5, the counterbalance valve 212 includes a first port 214 in fluid communication with the head end 206 of the hydraulic actuator 202. The first port 214 receives a fluid flow from the head end 206 via the fluid line 210. Specifically, during a lowering operation of the mast 113 (see FIG. 2), the first port 214 receives the fluid flow from the head end 206.

The counterbalance valve 212 further includes a second port 216 that fluidly communicates with the first port 214. The second port 216 is in selective fluid communication with the first port 214. Specifically, the first and second ports 214, 216 are in fluid communication with each other when the counterbalance valve 212 is in an open position. The counterbalance valve 212 includes a pilot port 218 that operates to fluidly communicate the first port 214 and the second port 216. The pilot port 218 provides a pilot pressure to the counterbalance valve 212 to fluidly communicate the first port 214 and the second port 216. The counterbalance valve 212 includes a housing 213. The first and second ports 214, 216 are defined by the housing 213.

The counterbalance valve 212 also includes a spring chamber 228 defined within the housing 213. The counterbalance valve 212 includes a spring 230 disposed within the spring chamber 228. The spring 230 compresses for example, via one or more sub-assemblies of the counterbalance valve 212, upon receipt of the pilot pressure through the pilot port 218. It should be noted that, a biasing force of the spring 230 determines a pressure setting of the counterbalance valve 212. The term "pressure setting" as used herein corresponds to a pressure value that causes the counterbalance valve 212 to open and allow the fluid flow therethrough.

The counterbalance valve 212 further includes an atmospheric vent passage 220. The atmospheric vent passage 220 is in fluid communication with the spring chamber 228. The atmospheric vent passage 220 is formed in the housing 213. The counterbalance valve 212 further includes an O-ring 222 disposed in the atmospheric vent passage 220. The O-ring 222 may prevent ingress of foreign material for example dust, or fluid inside the spring chamber 228. Further, the O-ring 222 may prevent leakage of fluid from the counterbalance valve 212.

With reference to FIGS. 3 to 5, during a raising operation of the mast 113 i.e., from the transport position to the drilling position, the fluid from the fluid tank is supplied to the head end 206 of the hydraulic actuator 202 through the fluid line 210. The fluid passes through the reverse free flow check valve 226 that further passes the fluid to the head end 206 of the hydraulic actuator 202. The fluid supplied to the head end 206 pushes the rod member 205 towards the rod end 204 that causes extension of the hydraulic actuator 202 and raising of the mast 113. Further, the movement of the rod member 205 towards the rod end 204 generates a pressure to open a counterbalance valve 232 associated with the rod end 204. The fluid flows back to the fluid tank via the fluid supply line 224.

Further, during the lowering operation of the mast 113, i.e., from the drilling position to the transport position, the fluid from the fluid tank is supplied to the rod end 204 of the hydraulic actuator 202 through the fluid supply line 224. The fluid supplied to the rod end 204 pushes the rod member 205 towards the head end 206 that causes retraction of the hydraulic actuator 202 and movement of the mast 113 towards the transport position. Further, the movement of the rod member 205 towards the head end 206 generates the pilot pressure at the pilot port 218 of the counterbalance valve 212. The pilot pressure compresses the spring 230 which causes fluid communication between the first port 214 and the second port 216 such that the fluid flows towards the second port 216 and then back to the fluid tank, via the reverse free flow check valve 226. During the lowering operation of the mast 113, the orifice 234 generates a back pressure in the hydraulic actuator 202. Specifically, the back pressure is experienced in the head end 206 of the hydraulic actuator 202. The back pressure is also experienced in the fluid line 210. The back pressure is generated upstream of the orifice 234 and is experienced by the counterbalance valve 212.

If the back pressure is not alleviated, the back pressure may damage sealing elements (not shown) of the hydraulic actuators 202 and/or other components of the system 200, such as, the fluid line 210. Further, the back pressure acts on the spring 230 of the counterbalance valve 212 and may spike the pressure setting of the counterbalance valve 212.

During the lowering operation of the mast 113 the back pressure in the hydraulic actuator 202 is alleviated, via the atmospheric vent passage 220. Further, the atmospheric vent passage 220 is configured such that the pressure setting of the counterbalance valve 212 is not affected by the back pressure prevailing at the second port 216.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the system 200 for moving the mast 113 of the drilling machine 100. The system 200 includes the counterbalance valve 212. The counterbalance valve 212 is mounted on the cylinder 203 of the hydraulic actuator 202 proximal to the head end 206 of the hydraulic actuator 202 to prevent any fluid column resonance effect of oil for example. The counterbalance valve 212 includes the atmospheric vent passage 220. During the lowering operation of the mast 113, the back pressure is generated in the hydraulic actuator 202 and the fluid line 210 which is greater than a capacity of the hydraulic actuator 202. The back pressure in the hydraulic actuator 202 is alleviated via the atmospheric vent passage 220, thereby reducing the trapped pressure inside the hydraulic actuator 202. As such, an incorporation of the atmospheric vent passage 220 may cause the back pressure in the counterbalance valve 212 to correspond to atmospheric pressure. Thus, the atmospheric vent passage 220 provides a simple technique of reducing the back pressure within the hydraulic actuator 202 and the fluid line 210.

Further, the atmospheric vent passage 220 does not affect the pressure setting of the counterbalance valve 212. Specifically, pressurized fluid inside the hydraulic actuator 202 may spike the pressure setting of the counterbalance valve 212. As the back pressure is alleviated to the atmosphere, the atmospheric vent passage 220 may prevent the spike in the pressure setting. Further, as the back pressure is alleviated to the atmosphere, the system 200 may eliminate a need of a separate drain hose to be coupled to the counterbalance valve 212 that is otherwise required to reduce the back pressure in the head end 206 of the hydraulic actuator 202 and the fluid line 210. Thus, the system 200 may reduce cost and complexity associated with addition of the separate drain hose.

Further, by alleviating the back pressure to the atmosphere, the system 200 may prevent failure of the sealing elements of the hydraulic actuators 202, may prevent leakage within the hydraulic actuator 202, and may prevent damage to the components of the system 200, such as, the fluid line 210. Thus, the system 200 of the present disclosure may reduce servicing and maintenance costs associated with the drilling machine 100 and may also improve a run time of the drilling machine 100.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

What is claimed is:

1. A system for moving a mast of a drilling machine, the system comprising:

a hydraulic actuator defining a rod end and a head end, wherein the rod end of the hydraulic actuator is coupled to the mast to move the mast about a pivot axis;

a fluid line in fluid communication with the head end of the hydraulic actuator; and a counterbalance valve disposed in the fluid line, wherein the counterbalance valve is disposed in fluid communication with the head end of the hydraulic actuator, wherein the counterbalance valve includes an atmospheric vent passage, and wherein, during a lowering operation of the mast, a back pressure in the hydraulic actuator is alleviated, via the atmospheric vent passage.

2. The system of claim 1, wherein the counterbalance valve includes:

a first port in fluid communication with the head end of the hydraulic actuator, wherein the first port is adapted to receive a fluid flow from the head end via the fluid line;

a second port adapted to fluidly communicate with the first port; and a pilot port that operates to fluidly communicate the first port and the second port, wherein the pilot port provides a pilot pressure to the counterbalance valve to fluidly communicate the first port and the second port.

3. The system of claim 2, wherein the atmospheric vent passage is configured such that a pressure setting of the counterbalance valve is not affected by a back pressure prevailing at the second port.

4. The system of claim 1 further comprising a reverse free flow check valve, wherein the reverse free flow check valve includes an orifice, wherein the counterbalance valve is disposed between the orifice and the head end of the hydraulic actuator, wherein the orifice is in fluid communication with the head end of the hydraulic actuator via the counterbalance valve, and wherein, during the lowering operation of the mast, the orifice generates the back pressure in the hydraulic actuator.

5. The system of claim 1 further comprising a manifold coupled to the hydraulic actuator proximal to the head end of the hydraulic actuator.

6. The system of claim 5, wherein the counterbalance valve is coupled to the manifold.

7. The system of claim 5, wherein the manifold is coupled to the hydraulic actuator by one or more fastening means, a welding process, or a forging process.

8. A mast assembly for a drilling machine, the mast assembly comprising:

a mast; and a system for moving the mast, the system including:

a hydraulic actuator defining a rod end and a head end, wherein the rod end of the hydraulic actuator is coupled to the mast to move the mast about a pivot axis;

a fluid line in fluid communication with the head end of the hydraulic actuator; and a counterbalance valve disposed in the fluid line, wherein the counterbalance valve is disposed in fluid communication with the head end of the hydraulic actuator, wherein the counterbalance valve includes an atmospheric vent passage, and wherein, during a lowering operation of the mast, a back pressure in the hydraulic actuator is alleviated, via the atmospheric vent passage.

9. The mast assembly of claim 8, wherein the counterbalance valve includes:

a first port in fluid communication with the head end of the hydraulic actuator, wherein the first port is adapted to receive a fluid flow from the head end via the fluid line;

a second port adapted to fluidly communicate with the first port; and a pilot port that operates to fluidly communicate the first port and the second port, wherein the pilot port provides a pilot pressure to the counterbalance valve to fluidly communicate the first port and the second port.

10. The mast assembly of claim 9, wherein the atmospheric vent passage is configured such that a pressure setting of the counterbalance valve is not affected by a back pressure prevailing at the second port.

11. The mast assembly of claim 8, wherein the system further includes a reverse free flow check valve, wherein the reverse free flow check valve includes an orifice, wherein the counterbalance valve is disposed between the orifice and the head end of the hydraulic actuator, wherein the orifice is in fluid communication with the head end of the hydraulic actuator via the counterbalance valve, and wherein, during the lowering operation of the mast, the orifice generates the back pressure in the hydraulic actuator.

12. The mast assembly of claim 8 further comprising a manifold coupled to the hydraulic actuator proximal to the head end of the hydraulic actuator.

13. The mast assembly of claim 12, wherein the counterbalance valve is coupled to the manifold.

14. The mast assembly of claim 12, wherein the manifold is coupled to the hydraulic actuator by one or more fastening means, a welding process, or a forging process.

15. A drilling machine comprising:

a frame;

a mast coupled to the frame that is movable relative to the frame; and a system for moving the mast relative to the frame, the system including:

a hydraulic actuator defining a rod end and a head end, wherein the rod end of the hydraulic actuator is coupled to the mast to move the mast about a pivot axis;

a fluid line in fluid communication with the head end of the hydraulic actuator; and a counterbalance valve disposed in the fluid line, wherein the counterbalance valve is disposed in fluid communication with the head end of the hydraulic actuator, wherein the counterbalance valve includes an atmospheric vent passage, and wherein, during a lowering operation of the mast, a back pressure in the hydraulic actuator is alleviated, via the atmospheric vent passage.

16. The drilling machine of claim 15, wherein the counterbalance valve includes:

a first port in fluid communication with the head end of the hydraulic actuator, wherein the first port is adapted to receive a fluid flow from the head end via the fluid line;

a second port adapted to fluidly communicate with the first port; and a pilot port that operates to fluidly communicate the first port and the second port, wherein the pilot port provides a pilot pressure to the counterbalance valve to fluidly communicate the first port and the second port.

17. The drilling machine of claim 16, wherein the atmospheric vent passage is configured such that a pressure setting of the counterbalance valve is not affected by a back pressure prevailing at the second port.

18. The drilling machine of claim 15, wherein the system further includes a reverse free flow check valve, wherein the reverse free flow check valve includes an orifice, wherein the counterbalance valve is disposed between the orifice and the head end of the hydraulic actuator, wherein the orifice is in fluid communication with the head end of the hydraulic actuator via the counterbalance valve, and wherein, during the lowering operation of the mast, the orifice generates the back pressure in the hydraulic actuator.

19. The drilling machine of claim 15 further comprising a manifold coupled to the hydraulic actuator proximal to the head end of the hydraulic actuator.

20. The drilling machine of claim 19, wherein the counterbalance valve is coupled to the manifold.

* * * * *